US005494488A

United States Patent [19]

Arnoldi et al.

[11] Patent Number: 5,494,488

[45] Date of Patent: Feb. 27, 1996

[54] DETERGENT COMPOSITION AND METHOD OF USE WITH SURFACTANT, SILICATE, AND POLYCARBOXYLATE

[75] Inventors: Detlef Arnoldi, Weisenheim am Berg; Wolfgang Leonhardt, Frankfurt am Main; Beata-Maria Lortz, Gelnhausen; Maurizio Ragnetti, Mainz-Kostheim, all of Germany

[73] Assignee: Degussa Aktiengesellschaft, Frankfurt am Main, Germany

[21] Appl. No.: 191,506

[22] Filed: Feb. 4, 1994

[30] Foreign Application Priority Data

Feb. 5, 1993 [DE] Germany ..... 43 03 320.2

[51] Int. Cl.[6] ..... D06M 15/263; D06M 11/79; C11D 3/08; C11D 3/37

[52] U.S. Cl. ..... 8/137; 252/179; 252/181; 252/174.23; 252/174.24; 252/174.25; 252/174.14; 252/174; 252/DIG. 2; 252/DIG. 1; 252/140; 252/135; 252/DIG. 15; 252/527; 252/546; 252/173; 252/DIG. 14; 252/186.1

[58] Field of Search ..... 252/179, 181, 252/174.23, 174.24, 174.25, 174.14, 174.13, 174, DIG. 1, 140, 135, DIG. 15, 527, 546, 173, DIG. 14, 186.1, DIG. 2; 8/137

[56] References Cited

U.S. PATENT DOCUMENTS

| | | | |
|---|---|---|---|
| 3,308,067 | 3/1967 | Diehl | 252/174.25 X |
| 3,793,222 | 2/1974 | Haschke et al. | 252/180 |
| 3,923,742 | 12/1975 | Haschke et al. | 252/174.24 X |
| 3,962,132 | 6/1976 | Haschke et al. | 252/179 X |
| 4,146,495 | 3/1979 | Crutchfield et al. | 252/180 X |
| 4,790,949 | 12/1988 | Dankowski et al. | 252/174.25 X |
| 4,849,125 | 7/1989 | Seiter et al. | 252/174.24 X |
| 4,919,845 | 4/1990 | Vogt et al. | 252/174.24 X |
| 5,076,957 | 12/1991 | Diehl et al. | 252/174.24 |
| 5,078,895 | 1/1992 | Dany et al. | 252/140 X |
| 5,133,894 | 7/1992 | Gethoeffer | 252/174.24 |
| 5,298,185 | 3/1994 | Leonhardt et al. | 252/174.23 X |
| 5,385,959 | 1/1995 | Tsaur et al. | 252/174.13 X |

FOREIGN PATENT DOCUMENTS

| | | |
|---|---|---|
| 0401780 | 12/1990 | European Pat. Off. . |
| 1942556 | 3/1971 | Germany . |
| 2354432 | 5/1975 | Germany . |
| 2408873 | 9/1975 | Germany . |
| 1296412 | 11/1972 | United Kingdom . |
| 1296413 | 11/1972 | United Kingdom . |

OTHER PUBLICATIONS

Witiak, D., "Acrylate Detergent Polymers in Industrial and Institutional Detergents", Chemical Times & Trends, pp. 40–45 (Oct. 1986).

Nagarajan, M., "Multi–Functional Polyacrylate Polymers in Detergents", *JAOCS*, 62(5), 949–55 (May 1985).

*Primary Examiner*—Douglas J. McGinty

*Attorney, Agent, or Firm*—Cushman Darby & Cushman

[57] ABSTRACT

A detergent composition with improved dirt-suspending power, method for its production and use of a suitable polycarboxylate for this purpose. The novel detergent contains, in addition to the customary components such as surfactant, calcium-binding silicate, etc., at least 1% by weight of a polycarboxylate with the schematic structure (X, Y, Z) in which X stands for Y for and Z for $-(F)_q-$.

These carboxylates can be produced from acrolein and optionally one or several comonomers by means of oxidizing radical donors without saponifying conditions and/or without subsequent Cannizzaro reaction. The novel detergents exhibits improvements over traditionally used co-builders in all essential detergent qualities. The carboxylates may be used in detergents, fine-fabric detergents, color detergents, liquid detergents and compact detergents.

9 Claims, 10 Drawing Sheets

Current Data Parameters
NAME sep291.14
EXPNO 10
PROCNO 1
USER demo
DU w

F2 - Acquisition Parameters
Date 910910
Time 19.19
PULPROG zg30
NUCLEUS 1H
SOLVENT D20
AQ 3.2112715 sec
FIDRES 0.155702 Hz
DW 49.0 usec
RG 32
HL1 1 dB
D1 0.5000000 sec
P1 17.0 usec
DE 61.3 usec
SFO1 500.1396189 MHz
SWH 10204.06 Hz
TD 65536
NS 120
DS 16

F2 - Processing parameters
SI 32768
SF 500.1365557 MHz
WDW EM
SSB 0
LB 0.00 Hz
GB 0
PC 4.00

1D NMR plot parameters
CX 33.00 cm
CY 20.00 cm
F1P 10.500 ppm
F2P -0.500 ppm
PPMCM 0.33333 ppm/cm
HZCM 166.71219 Hz/cm Current Data Parameters
NAME sep391.97
EXPNO 10
PROCNO 1
USER demo
DU w F2 - Acquisition Parameters
Date 910923
Time 17.17
PULPROG zg30
NUCLEUS 1H
SOLVENT D20
AQ 3.2112715 sec
FIDRES 0.155702 Hz
DW 49.0 usec
RG 256
HL1 1 dB
D1 0.5000000 sec
P1 17.0 usec
DE 61.3 usec
SFO1 500.1396189 MHz
SWH 10204.06 Hz
TD 65536
NS 240
DS 2

F2 - Processing parameters
SI 32768
SF 500.1366926 MHz
WDW EM
SSB 0
LB 0.00 Hz
GB 0
PC 4.00

1D NMR plot parameters
CX 33.00 cm
CY 585.00 cm
F1P 5.500 ppm
F2P 0.500 ppm
PPMCM 0.15152 ppm/cm
HZCM 75.77829 Hz/cm

DETERGENT COMPOSITION AND METHOD OF USE WITH SURFACTANT, SILICATE, AND POLYCARBOXYLATE

The present invention relates to a preferably phosphate-poor or phosphate-free, zeolite-containing detergent system, a method for its production and the use of a suitable polycarbonate for this purpose.

BACKGROUND OF THE INVENTION

The development of detergent builders has been influenced in recent years in general by an expansion of phosphate-free detergents. Zeolite A is the most frequent builder replacement for phosphate. Because of the slower exchange kinetics of the zeolite with $Ca^{++}$ ions, phosphate-free powdery and liquid detergents and cleaning agents also require, in addition to the main builder, zeolite A, so-called co-builders such as e.g. soda, polycarboxylates, NTA, silicates or hydroxycarboxylates.

Conventional builder additives are currently polymeric carboxylic acids and their salts. For example, homopolymers of acrylic acid or copolymers based on acrylic acid with maleic acid, such as those described in Published German Patent Applications 20 25 238, 20 44 601, in European Application EP 0 137 669 or in Published German Patent Application DE 36 04 223 A1, are preferred for detergents and cleaning agents. These products contribute to the washing performance of detergents by improving their soil and redeposition power:

On the one hand, they prevent the dirt from redepositing on the articles being washed, which can cause an undesirable greying of the textiles, and on the other hand they reduce the deposition of inorganic salts (incrustation) on those articles.

Polycarboxylates in conjunction with zeolites or phyllosilicates are known from, among others, EP 0 401 780.

It has been found that the secondary washing effects of greying and incrustation could be reduced by commercial polycarboxylates; however, a further optimization of these co-builders is desirable in order to improve the effectiveness of detergents and to further improve, at the same time, the useful properties of textiles.

SUMMARY OF THE INVENTION

The object of the invention is to provide a phosphate-poor or phosphate-free, zeolite-containing detergent system with an improved co-builder. These and other objects are fulfilled with a detergent system containing:

| | |
|---|---|
| Detergent or surface active agent | 5–40% by weight |
| Calcium-binding silicate | 5–50% by weight |
| Polycarboxylate | 1–20% by weight |
| Further silicate | 0–30% by weight |
| Carbonate | 0–30% by weight |
| Organic complexing agent | 0–10% by weight |
| Phosphonate | 0–5% by weight |
| Phosphate | 0–30% by weight |
| Hydroxycarboxylic acid | 0–20% by weight |
| Bleaching agent | 0–30% by weight |
| Bleaching-agent activator | 0–10% by weight |
| Optical brightener | 0–5% by weight |
| Enzyme | 0–30% by weight |
| Greying inhibitor | 0–5% by weight |
| Defoamer | 0–8% by weight |
| Fillers | 0–40% by weight, |

with at least 1% by weight of the composition being a polycarboxylate having the formula (X, Y, Z) in which X stands for

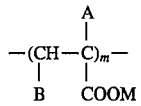

Y stands for

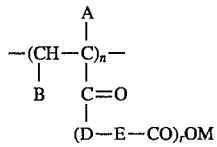

and Z for $$-(F)_q-,$$

in which

A=H, OH, $C_{1-6}$ alkyl, $CH_2CO(DECO)_{r-1}OM$;

B=H, OH, $C_{1-6}$ alkyl, COOM

D=O, NH

E=$C_{1-6}$ alkyl, linear or branched

F=a copolymerizable monomer;

M=H, alkali metal or alkaline-earth metal, ammonium, substituted ammonium; also, in the case of X, $-(CH_2-CH_2-O)_{2-4}M$;

r=1–5;

and m=0–99.5 molar % n=0.5–100 molar % q=0–5 molar % and wherein m+n+q=100 molar %.

The novel detergent system contains, in addition to a calcium-ion-binding silicate, at least one (co)polymer, preferably of acrylic acid and/or acrolein. The invention also includes the use of these substances in phosphate-free or phosphate-reduced, powdery or liquid detergents and cleaning agents.

As indicated above, the detergent of the invention contains:

| | |
|---|---|
| Surfactant | 5–40% by weight |
| Calcium-binding silicate | 5–50% by weight |
| Polycarboxylate | 1–20% by weight |
| Further silicate | 0–30% by weight |
| Carbonate | 0–30% by weight |
| Organic complexing agent | 0–10% by weight |
| Phosphonate | 0–5% by weight |
| Phosphate | 0–30% by weight |
| Hydroxycarboxylic acid | 0–20% by weight |
| Bleaching agent | 0–30% by weight |
| Bleaching-agent activator | 0–10% by weight |
| Optical brightener | 0–5% by weight |
| Enzyme | 0–30% by weight |
| Greying inhibitor | 0–5% by weight |
| Defoamer | 0–8% by weight |
| Fillers | 0–40% by weight, |

with at least 1% by weight of the composition being a polycarboxylate with the schematic structure (X, Y, Z) in which X, Y and Z have the meanings given above.

The detergent of the invention can also be defined as follows:

| | |
|---|---|
| Surfactant | 5–40% by weight |
| Calcium-binding silicate | 5–50% by weight |
| Polycarboxylate | 1–20% by weight |
| Further silicate | 0–30% by weight |
| Carbonate | 0–30% by weight |
| Organic complexing agent | 0–10% by weight |
| Phosphonate | 0–5% by weight |
| Phosphate | 0–30% by weight |
| Hydroxycarboxylic acid | 0–20% by weight |
| Bleaching agent | 0–30% by weight |
| Bleaching-agent activator | 0–10% by weight |
| Optical brightener | 0–5% by weight |
| Enzyme | 0–30% by weight |
| Greying inhibitor | 0–5% by weight |
| Defoamer | 0–8% by weight |
| Fillers | 0–40% by weight, |

wherein at least 1% by weight of the composition is a polycarboxylate which can be produced from acrolein and optionally one or several comonomers by means of oxidizing radical donors without saponifying conditions and/or without subsequent Cannizzaro reaction, and/or that at least 1% by weight of the composition is a polycarboxylate which can be produced from acrolein and optionally one or several comonomers by means of oxidizing radical donors and has a component of functional groups of the type $$—C(O)—O[—CH_2—CH_2C(O)O]_rR'$$

in which R' stands for an alkali cation, alkaline-earth cation or nitrogen-containing cation and/or that at least 1% by weight of the composition is a polycarboxylate which can be produced from acrolein and optionally one or several comonomers by means of oxidizing radical donors and that the polycarboxylate is mixed especially all at once or in immediate succession with several, especially all further above-named components, optionally with the addition of $H_2O$ and is optionally dried.

The above-described detergent of the invention preferably contains, in addition to the named components, at least one of the following components in the following indicated amount:

| | |
|---|---|
| Surface Active Agent | 7–30% by weight |
| especially | 10–20% by weight, |
| Polycarboxylate | 2–10% by weight |
| Further silicate | 3–15% by weight |
| Carbonate | 3–15% by weight |
| Organic complexing agent | 0.5–5% by weight |
| Phosphonate | 0.1–1% by weight |
| Phosphate | 0–5% by weight |
| especially | 0–1% by weight |
| Hydroxycarboxylic acid | 2–10% by weight |
| Bleaching agent | 10–25% by weight |
| Bleaching-agent activator | 2–8% by weight |
| Optical brightener | 0.1–0.3% by weight |
| Enzyme | 0.3–1% by weight |
| Greying inhibitor | 0.5–1.5% by weight |
| Defoamer | 0–3.5% by weight |
| Fillers | 0–20% by weight, |

The composition contains 2–8% by weight each of polycarboxylate and of bleaching agent activator as compact detergent.

If the detergent composition is a formulation as liquid detergent, it then contains:

| | |
|---|---|
| Anionic surfactants | 5–15% by weight |
| Non-ionic surfactants | 10–20% by weight |
| Calcium-binding silicate | 10–25% by weight |

-continued

| | |
|---|---|
| Polycarboxylate | 1–5% by weight |
| Bleaching agent | 0% by weight |
| Bleaching-agent activator | 0% by weight |
| Co-builder | 0–8% by weight |
| Solubilizer | 0–30% by weight |
| Water | 0–50% by weight |

For a formulation as fine-fabric detergent, the detergent composition contains:

| | |
|---|---|
| Anionic surfactants | 5–15% by weight |
| Non-ionic surfactants | 1–10% by weight |
| Calcium-binding silicate | 10–50% by weight |
| Polycarboxylate | 1–5% by weight |
| Bleaching agent | 0% by weight |
| Bleaching-agent activator | 0% by weight |
| Carbonate | 0–20% by weight. |

The invention also relates to the use of a polycarboxylate with the schematic structure (X, Y, Z) in which X, Y and Z have the meanings given above at 1–20% by weight of a detergent composition containing 5–50% by weight of a silicate binding calcium ions and containing 5–40% by weight surfactant.

The use of a polycarboxylate, which can be prepared from acrolein and optionally one or several comonomers by means of oxidizing radical donors without saponifying conditions and/or without subsequent Cannizzaro reaction, at 1–20% by weight of a detergent composition containing 5–50% by weight of a silicate binding calcium ions and containing 5–40% by weight surfactant is also part of the invention.

Finally, the present invention also includes the use of a polycarboxylate which can be produced from acrolein and optionally one or several comonomers by means of oxidizing radical donors and a) Has a component of functional groups of the type $—C(O)—O[—CH_2—CH_2C(O)O]_xR'$ in which R' stands for a cation containing alkali, alkaline earth or nitrogen and x=1–5 at 1–20% by weight of a detergent composition containing 5–50% by weight of a silicate binding calcium ions and containing 5–40% by weight surfactant, and/or b) The polycarboxylate is mixed with several, especially all components optionally with the addition of $H_2O$ and optionally dried at 1–20% by weight of a detergent composition containing 5–50% by weight of a silicate binding calcium ions and containing 5–40% by weight surfactant.

The invention also includes a method for producing the above-described detergent compositions in which method the individual powdery components are homogeneously mixed with each other by mixing and the liquid components by spraying onto the solids. Alternatively, components which are not sensitive to water and heat can first be mixed with water to form a slurry which is subsequently spray-dried; the remaining components are subsequently mixed, as explained above.

Particularly in the case of compact detergents, the components are advantageously agglomerated by forced mixing or are extruded.

The liquid detergents are produced by mixing with an appropriate amount of solubilizer or on water and optionally concentrated.

All individual components of the composition can be present as pure substance or as a mixture of appropriate components. Substances which are insoluble in water, especially zeolites, are preferred as calcium-binding silicate.

In a preferred embodiment of the invention, there can be used, as a silicate capable of binding calcium ions and insoluble in water, a finely distributed, synthetically produced compound which is insoluble in water, contains bound water and has the general formula:

$$(Cat_{2/n}O)_x.Me_2O_3.(SiO_2)_y \quad (I),$$

in which Cat signifies a cation with the valence n which is exchangeable with calcium, x signifies a number from 0.7 to 1,5, Me signifies boron or aluminum and y signifies a number from 0.8 to 6.

Aluminum silicates are particularly preferred.

The aluminum silicates to be used can be amorphous or crystalline products. Of course, mixtures of amorphous and crystalline products and even partially crystalline products can also be used. The aluminum silicates can be naturally occurring or synthetically produced products but the synthetically produced products are preferred. The production can take place e.g. by means of the reaction of water-soluble silicates with water-soluble aluminates in the presence of water. To this end aqueous solutions of the starting materials can be mixed with each other or a component present in a solid state caused to react with the other component present as aqueous solution. The desired aluminum silicates are also obtained by mixing both components present in a solid state in the presence of water. Aluminum silicates can also be produced from $Al(OH)_3$, $Al_2O_3$ or $SiO_2$ by causing them to react with alkali silicate solutions or aluminate solutions. The preparataion can also take place in accordance with further known methods. The invention relates in particular to aluminum silicates which have a three-dimensional space lattice structure. The preferred calcium binding capacity, present approximately in the range of 100 to 200 mg CaO/g active substance (AS), usually at approximately 100 to 180 mg CaO/g AS, is present especially in compounds with the composition:

$$0.7\text{–}1.1\ Na_2O_{13}Al_2O_3_1.3\text{–}3.3\ SiO_2.$$

This empirical formula comprises two types of different crystal structure (and their non-crystalline intermediates, i.e. products), which also differ from each other by their empirical formula. They are:

a) $0.7\text{–}1.1\ Na_2O.Al_2O_3$—$1.3\text{–}2.4\ SiO_2$.

b) $0.7\text{–}1.1\ Na_2O.Al_2O_3_2.4\text{–}3.3\ SiO_2$.

The different crystal structures are evident in an X-ray diffraction diagram.

The amorphous or crystalline aluminum silicate present in aqueous suspension can be separated by filtration from the remaining aqueous solution and dried at temperatures of e.g. 50° to 400° C. The product contains more or less bound water as a function of the drying conditions. It is advantageous not to exceed 200° C. if the aluminum silicate is intended for use in detergents and cleaning agents. However, the aluminum silicates do not need to be dried at all after their production in order to prepare a suspension in accordance with the invention; on the contrary—and this is especially advantageous—an aluminum silicate which is still moist from its production can be used. However, aluminum silicates dried at medium temperatures, e.g. at 80° to 200° C., until adhering liquid water is removed, can also be used to prepare suspensions in accordance with the invention.

The particle size of the individual aluminum silicate particles can be different and be e.g. in a range between 0.1 μ and 0.1 mm. This range refers to the primary particle size, that is, the size of the particles accumulating during the precipitation and optionally during the subsequent crystallization. It is especially advantageous to use aluminum silicates consisting of at least 80% by weight of particles with a size of 10 to 0.01 μ, in particular 8 to 0.1 μ.

These aluminum silicates preferably no longer contain any primary or secondary particles with diameters above 45 μ. Particles formed by means of agglomeration of the primary particles to larger structures are designated as secondary particles.

As regards the agglomeration of the primary particles to larger structures, the use of aluminum silicates still moist from their production has proven to be especially effective for producing the suspensions in accordance with the invention since it was found that, when these still moist products are used, formation of secondary particles is practically totally prevented.

In an especially preferred embodiment of the invention, powdery zeolite, especially of type A, preferably with particularly defined particle spectrum is used as calcium-binding silicate.

Such zeolite powders can be produced according to the disclosures of German Patent Applications DE-AS 24 47 021, DE-AS 25 17 218, DE-OS 26 52 419, DE-OS 26 51 420, DE-OS 26 51 436, DE-OS 26 51 437, DE-OS 26 51 445 and DE-OS 26 51 485. They then exhibit the particle distribution curves indicated in those documents.

In an especially preferred embodiment, a powdery zeolite of type A can be used which exhibits the particle size distribution described in DE-OS 26 51 485.

The polycarboxylates can be used both as acid as well as salt and as partially neutralized substance; metal ions as well as nitrogen-containing cations are suitable as counterions.

The polymers of the invention with the structure (X, Y, Z) are preferably copolymers of acrylic acid and acrolein. The distribution of the monomers in the polymer is usually statistic (random) and the terminal groups of the polymer (X, Y, Z) are usually those produced under the corresponding reaction conditions. The copolymerizable monomer F is advantageously selected in such a manner that it does not adversely affect the co-builder action of the entire polymer. Suitable F monomers are:

Monoethylenically unsaturated monomers free of carboxyl groups. For example, hydroxy(meth)acrylates with $(CH_2)_xOH$ as ester group, in which x=2–4. (Meth)acrylamide, (meth)acrylonitrile, vinyl sulfonic acid, allyl sulfonic acid, dimethylaminoethyl(meth)acrylate, diethylaminoethyl(meth)acrylate, 2-(meth)acrylamido 2-methylpropane sulfonic acid, vinyl phosphonic acid, allyl phosphonic acid, allyl alcohol, vinyl glycol, vinyl acetate, allyl acetate, N-vinyl pyrrolidone, N-vinyl formamide, N-vinyl imidazole, N-vinyl imidazoline, 1-vinyl, -2-methyl-2-imidazoline. Esters of (meth)acrylic acid with 1–8 carbon atoms in the alcohol group such as e.g. methyl(meth)acrylate, ethyl(meth)acrylate, propyl(meth)acrylate, butyl(meth)acrylate optionally functionalized with alcohol groups or with amino groups, ethylene, propylene, methylvinyl ether, ethylvinyl ether, styrene and alphamethyl styrene. All monomeric acids and bases can optionally also be used as salts.

Multiply ethylenically unsaturated monomers. For example, esters of ethylene glycol, propylene glycol, butane diol and hexane diol with (meth)acrylic acid, maleic acid and fumaric acid, esters of polyethylene glycol and copolymers of ethylene glycol and propylene glycol with (meth-)acrylic acid, maleic acid and fumaric acid, addition products of ethylene oxide and/or propylene oxide on trimethylolpropane esterified twice to three times with (meth)acrylic acid or maleic acid, at least double esters from (meth)acrylic acid or maleic acid and glycerol or pentaerythritol, triallylamine, tetraallylethylene diamine, polyethylene glycol divinyl ether, trimethylol propane diallyl ether, butanediol diallyl ether, pentaerythritol triallyl ether, divinyl urea.

F monomers also include such polymer structural elements which were chemically modified under the selected reaction conditions vis-à-vis the corresponding starting materials.

For the Y component, on the one hand, monoethylenically unsaturated aldehydes such as acrolein and methacrolein, which are oxidized during the polymerization to the corresponding acid, are suitable, as are monoethylenically unsaturated esters or higher esterification homologs as well as amides corresponding to the Y structural element.

For the X component, monoethylenically unsaturated $C_3$ to $C_8$ mono- or dicarboxylic acids such as e.g. acrylic acid, methacrylic acid, fumaric acid, maleic acid as well as maleic acid anhydride, itaconic acid, citraconic acid, crotonic acid are suitable. The esters derived from these compounds as well as amides corresponding to the X structural element are also suitable.

The polycarboxylates to be used preferably according to the invention are polymeric co-builders containing 0.5–100 molar % of the monomer unit —($CH_2$—CHCOOR) in which R=$CH_2$—$CH_2$—COOR' and R' is H or R, as well as their salt form (e.g. alkali metals as well as ammonium ions are suitable as counterion).

The 1H-NMR is suited for quantitatively determining these ester-containing side chains, which seem to arise especially by the use of acrolein as monomer.

FIG. 1 shows a 1H NMR spectrum of a copolymer of 80% acrolein and 20% acrylic acid in $D_2O$. The spectrum was recorded on a Bruker AMX 500 spectrometer at 500.13 MHz. All low-molecular weight components can be separated by dialysis by means of a semipermeable membrane with the separating limit at 2,000 g/mole (calibration via polyoxyethylene). The NMR spectrum of the polymer purified in this manner (FIG. 2) permits the quantitative determination of the ester structure bound to the polymer, which becomes recognizable via the unambiguous signals at 4.4—4.4 ppm.

The average molecular weight (Mw) of the copolymers can fluctuate within a broad range and it must be taken into consideration that molecules with too low a degree of polymerization exhibit lesser washing performance whereas molecular weights which are too high cause an undesirable thickening action. Thus, copolymers with a molecular weight between 500 and 500,000 g/mole can be used but 2,000 to 100,000 g/mole or, even better, 5,000 to 50,000 g/mole are preferred.

Molecular weight is determined by gel permeation chromatography (GPC) on LiChrospher diol columns (firm—Merck) and with phosphate buffer (pH=7) as eluent solution. A calibration can best be carried out with finely divided polyacrylic acid. The non-constant chemical composition of the copolymers which are interesting for the present invention bring about an error in the absolute value of the molecular weight. This generally known error source can not be readily eliminated, so that all data presented in connection with the invention concerning the molecular weight are to be understood as relative to the calibration with polyacrylic acid.

Basically, mixtures of polymers both with different composition as well as with the same composition but different molecular weight can be used.

The acrylic acid polymers can be produced according to known methods. Helpful suggestions in this regard can be found in "Acrylic and Methacrylic Acid Polymers", J. W. Nemec and W. Bauer Jr. and in "Radical Polymerization", C. H. Baumford in Vols. 1 and 13 of the "Encyclopedia of Polymer Science and Technology", John Wiley & Sons, New York, 1990. Such methods are also described e.g. in "Acrylic Acid Polymers", M. L. Mitter in "Encyclopedia of Polymer Science and Technology", vol. 1, Interscience Publishers, New York, 1964.

The (co)polymers can be made by all conventional free radical polymerization methods. The following production methods are cited by way of example: Solution polymerization, in which the monomers are dissolved in water or in another solvent or solvent mixture with possible additives of low-molecular, organic and/or inorganic compounds. Precipitation polymerization in solvents in which the monomers are at least partially soluble and the polymers are not soluble. Emulsion polymerization and suspension polymerization in solvents in which the monomers are not soluble and the emulsions and suspensions are stabilized by the addition of low and/or high-molecular substances.

Even a polymerization induced by radiation can be used to produce the polymers.

However, solution polymerization in water, as described below, is preferred.

The monomer concentration may be in the range between 5 and 70%, 25 to 50% being preferred, depending on the viscosity of the polymer solution being produced.

Both thermally decomposable radical donors which exhibit a sufficient solubility in the selected solvent and in the monomers as well as multicomponent redox initiators are suitable as initiators. However, water-soluble substances such as hydrogen peroxide and alkali and ammonium peroxydisulfates are preferred.

The polymerization temperature is utilized together with the amount of initiator to regulate the molecular weight of the desired polymer. It is between 30° and 180° C. and it is advantageous to maintain it between 60° and 130° C. Low temperatures usually lead to polymers whose molecular weights are too high whereas temperatures which are too high can cause polymer degradation and coloring.

The molecular weight can also be regulated by suitable regulators such as thio derivatives and low-molecular alcohols. For example, thioglycolic acid, mercaptopropionic acid and their esters and 2-mercaptoethanol are suitable.

Similar polymers are known from DE 23 54 432 C3 and the literature mentioned in it. According to this publication, however, detergent polymers containing exclusively carboxyl groups, aldehydo groups, alcohols and vinyl groups are used with zeolites. That is, the polymers were subjected in part to a Cannizzaro reaction and generally produced under reaction conditions in which no ester groups are produced in the acrolein polymerization but alcohol groups are. Such polymers are also involved in the case of the practically uncross-linked, water-soluble polycarboxylic acids known from DE-OS 24 08 873.

Surfactants bring about the desired cleansing action via wetting and displacement of one liquid by another and assure, by means of oriented adsorption on pigment dirt and by solubilization of soluble impurities, as well as soil-suspending power, which is further developed by other components.

Surfactant combinations are always typical for detergent formulations since mixtures of different surface-active substances exhibit a synergistic action, that is, a performance which is greater than the addition of the individual effects.

Very efficient synergistic surfactant combinations are obtained from linear alkylbenzene sulfonates and fatty alcohol polyglycol ethers. For low wash temperatures (30° to 60° C.) longer-chain soaps are replaced for foam regulation by specially designed silicon oils.

A part of the alkylbenzene sulfonates can be replaced by alkyl sulfates, which, in addition, exhibit a more favorable anaerobic breakdown behavior. In the case of the fatty alcohol polyglycol ethers, there are alternatives for the hydrophobic molecule part, which is obtainable either on the basis of renewable or natural raw materials (fatty alcohols in the narrower sense) or petrochemically (oxo- or Ziegler alcohols). The new surfactant class of the alkylpolyglycosides, representatives of the non-ionics "without ethylene oxide", which are accessible exclusively on the basis of the renewable or natural raw materials fatty alcohols (fats and oils) and starch and sugar, are currently used especially for liquid detergents. In the case of fatty alcohol polyglycol ethers the trend is to the lower-ethoxylated products, which improve the washing out of fatty dirt, especially at low temperatures.

In particular, products for the oxidative removal of colored foreign matter are used as bleaching systems in detergents. The general trend of washing at rather low temperature as well as the increase of the amount of mixed fabrics which are more temperature-sensitive than cotton or linen make it necessary to use bleaching activators, since sodium perborate is not effective at temperatures below 60° to 70° C.

The activated bleach at or below 60° C. is based—when using N-acetyl compounds as bleaching-agent activators—on the formation of the peracetic acid anion in the wash liquor, which has a higher oxidation potential than the perhydroxide anion released by hydrolysis from perborate.

N,N,N',N'-tetraacetylethylene diamine (TAED) and 1,5-diacetyl-2,4-dioxohexahydro-1,3,5-triazine (DADHT) are suitable for transferring the acetyl group onto the perhydroxide anion. DADHT is somewhat more effective at low wash temperatures than TAED and has the advantage, in addition, that in distinction to TAED all acetyl groups available in the molecule are utilized in the bleach (only two out of four in TAED).

The peracetic acid anion is the most effective on hydrophilic, bleachable spots. Even long-chain diperoxycarboxylic acids such as e.g. dodecane-1,12-diperacid are effective, especially at rather low temperatures. The use of alkanoyloxy-benzene sulfonates (AOBS) with alkyl chain lengths of $C_8$–$C_{10}$ is advantageous, just as nonanoyloxybenzene sulfonate (NOBS). Hydrophilicity and lipophilicity maintain such a good balance between themselves in the nonane-1-peracid anion formed in the washing bath of NOBS and perborate (p-hydroxybenzene sulfonate as leaving group) that the bleaching power is, in spite of the active oxygen values in the washing bath, which are lesser in comparison to the TAED system, comparably good on the whole. Moreover, NOBS is nitrogen-free.

Sodium perborate tetrahydrate is replaced by the monohydrate especially in compact detergents.

The perborate can be substituted with percarbonate for ecological reasons (reduction of boron-charging of waste water), which has been, however, problematic in the past on account of the latter's lacking stability in detergents.

Even sodium perborate must be stabilized. In particular, the degradation caused by heavy metals, especially copper ions, as a consequence of which fiber damage can also occur, should be avoided. The complexing agents, such as EDTA, which were formerly used for this purpose have been largely eliminated from detergent formulations in the meantime on account of lacking biological degradability. Alternatives are e.g. certain protein hydrolyzates whose biuret structures are particularly suitable for the complexing of copper. Phosphonates also function in many instances as stabilizers.

Enzymes are almost necessary components in universal detergents and in many other formulations for washing and cleaning. The following are used: Pancreatin (trypsin), proteases, amylases, cellulases and lipases.

Proteases degrade usually high-molecular weight protein soilings such as blood spots and egg spots which can not be removed from the fiber by surfactants alone. The amylases usually employed together with proteases serve both to degrade the starch-containing dirt as well as to split the adhesive-like bond between fiber and particle dirt caused by starch itself as well as its breakdown products, the dextrins.

The cellulases (cellulose-degrading enzymes) not only make the cleaning possible but also the "softening" and freshen up the color of cotton textiles.

Lipases, that is, fat-splitting enzymes, strengthen washing power. They can contribute in particular to keep an increased use of surfactants at low wash temperatures within limits.

Optical brighteners, also called fluorescent whitening agents (FWA), absorb the UV component of sunlight in the wavelength range around 350 nm, which is not visible to the human eye, and emit blue (also bluish green, depending on structure) fluorescent radiation around 440 nm (500 nm). The fluorescent radiation of the whitening agents which have, for example, been applied to textile fibers, is added to the reflected visible light, so that not only any yellow hue of an actually white fabric, as can occur after multiple use and cleaning, is "supplemented" back to white but as a whole a more intensive, more "radiant" white is also achieved.

Stilbene derivatives are especially suitable. In addition, cumarin- and quinolone- (carbostyryl-) as well as 1,3-diphenylpyrazoline structures, naphthalene dicarboxylic-acid- and cinnamic acid derivatives as well as combinations of benzoxazole- or benzimidazole structures with conjugated systems also play a role.

Recently, polymers have also been used in detergents which prevent the transfer of color from one fabric to another. In particular, special polyvinylpyrrolidones and homopolymers of vinylimidazole are suited for this purpose. In return, bleaching systems and whitening agents are usually eliminated in universal detergent formulations which contain color-transfer inhibitors.

Carbonate such as soda serves to reinforce the washing action (alkali reserve).

Fillers such as e.g. sodium sulfate can be added in order to improve the handling properties and the free flow properties.

Further, silicate, e.g. water glass, acts as corrosion inhibitor; or e.g. magnesium silicate acts (like phosphonate) as stabilizer. Recently, however, amorphous and crystalline disilicates have also found use as co-builder and in special detergents as main builder.

Hydroxy carboxylic acids can be used as co-builder in addition to polymer and zeolite A and they assume a so-called carrier function for $Ca^{++}$ ions.

Greying inhibitors suspend the dissolved dirt in the washing liquor.

Phosphates can be used as the main builder in addition to zeolite A in p-reduced formulations and, in lesser amounts, phosphate as carrier assumes a co-builder function in the detergent.

Preferably, solubilizers are used in liquid detergents. For example, polyethylene glycols with different degrees of polymerization and molar weight are suitable for mixing with surfactants, alcohol or water.

Moreover, conventional or fairly new components can also be contained in the detergent compositions such as e.g. dyes, perfuming oils, softeners or the above-described color-transfer inhibitors.

BRIEF DESCRIPTION OF FIGURES OF DRAWING

The invention is illustrated in detail in the following examples and the drawings wherein.

PRODUCTION OF POLYCARBOXYLATES

EXAMPLE 1

Figure 1:
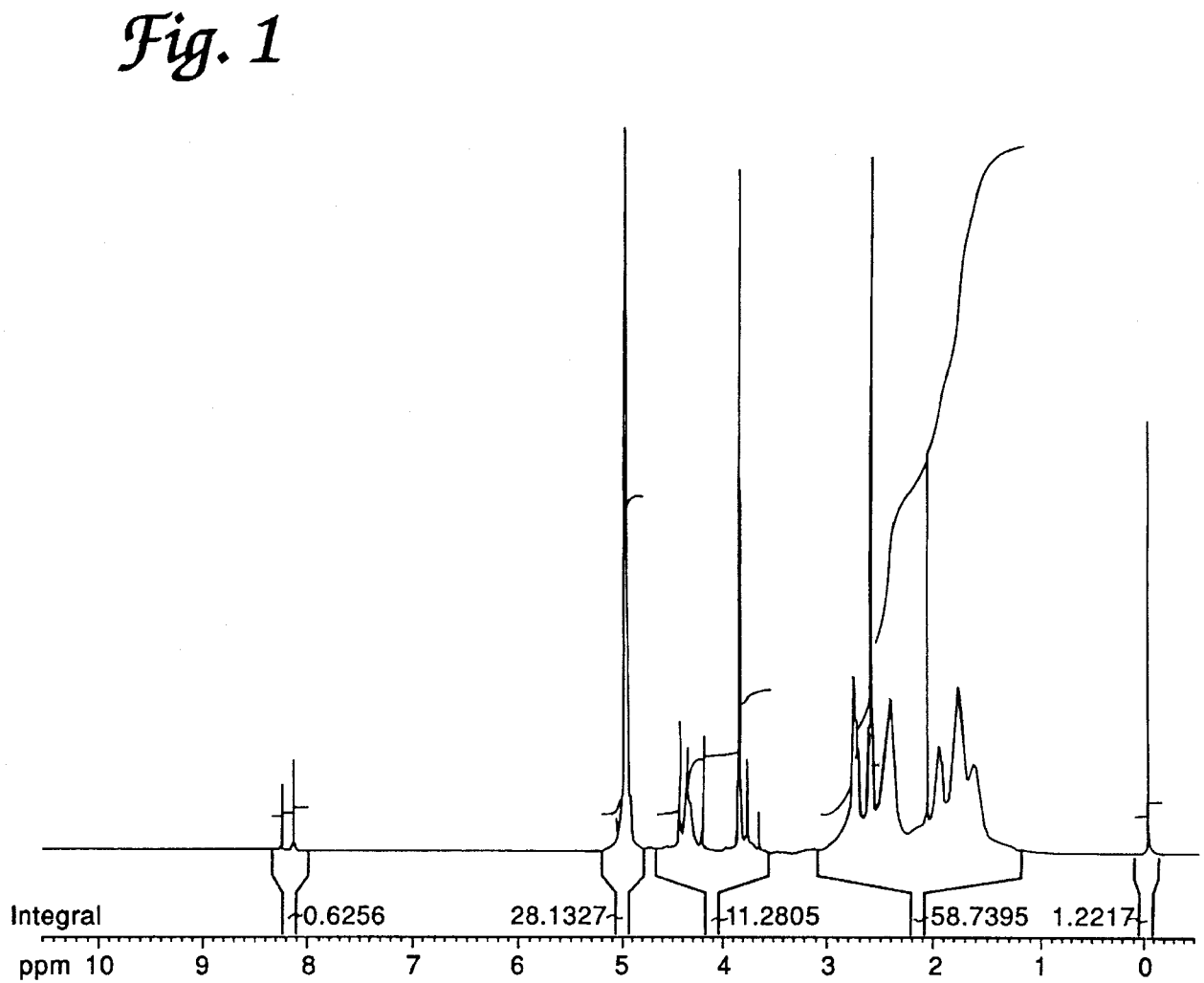
FIG. 1 shows an NMR spectrum of a polymer to be used in accordance with the invention.
Figure 2:
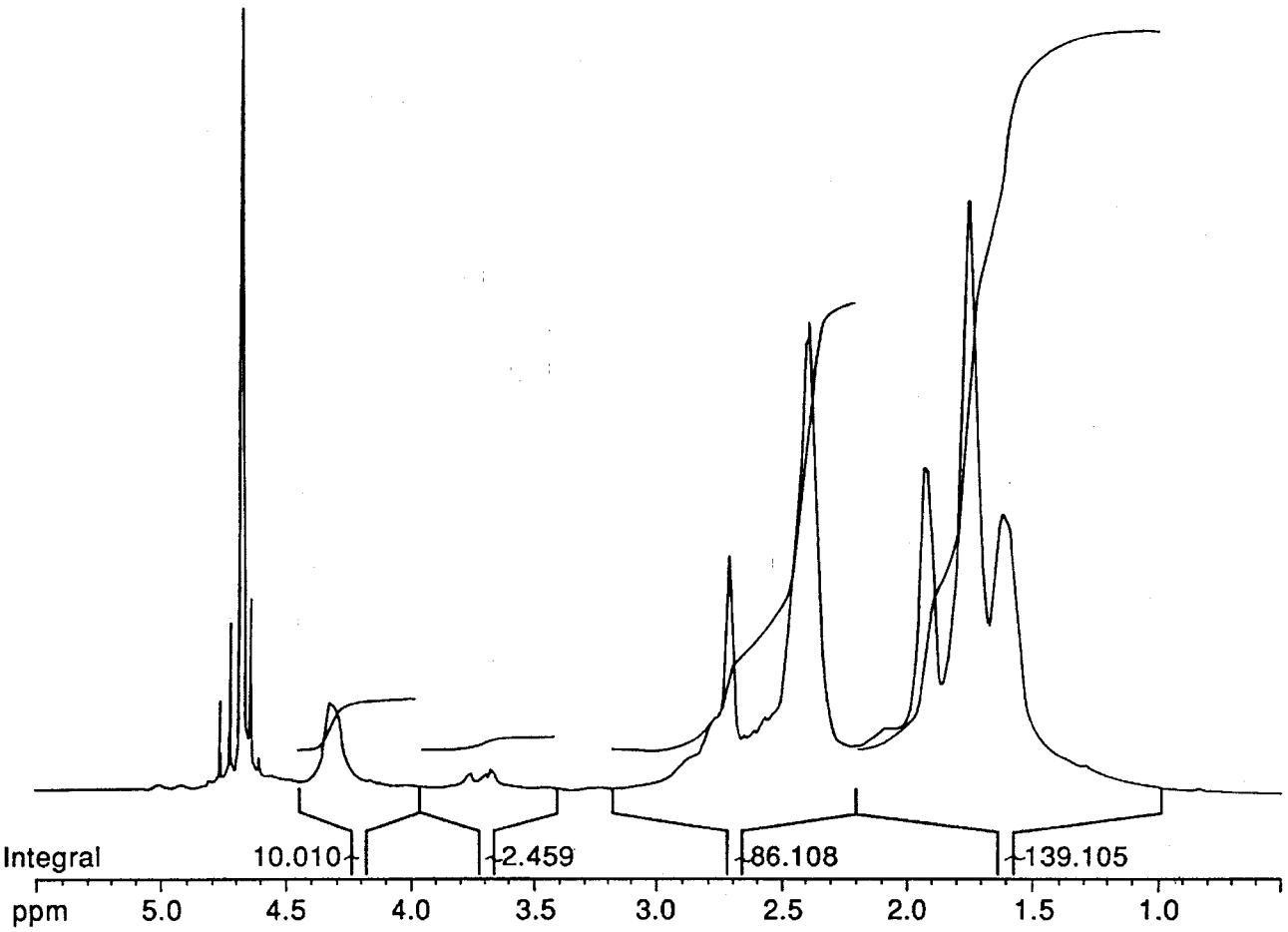
FIG. 2 shows an NMR spectrum of the polymer of FIG. 1 after dialysis.

720 parts by weight deionized water and 424 parts $H_2O_2$ (50%) are placed in a reactor equipped with condenser, agitator and tempering devices and heated to 70° C. 950 parts acrolein, 245 parts acrylic acid and 424 parts 50% $H_2O_2$are added simultaneously through separate lines over four hours with vigorous agitation. 105 minutes after the start of the introduction of reactants, the introduction of a total of 1000 parts deionized water begins, which flows in at 300 parts/hour.

After seven hours total reaction time the temperature is brought to 95° C. for a three-hour postreaction.

After cooling off, the contents of the reactor are adjusted with NaOH solution to pH 7–9.

A 35.1% polymer solution with a viscosity of 400 mPa.s is produced. The resulting polymer has an average molecular weight of 8000 g/mole.

Approximately 12% by weight with the structure —$CH_2$—CH—(COO—$CH_2$—$CH_2$—)$_r$COOR'—is demonstrated by 1H-NMR.

EXAMPLE 2

450 parts deionized water and 150 parts 50% $H_2O_2$are placed in a reactor similar to the one in Example 1 and heated to 90° C. 525 parts acrylic acid, 225 parts acrolein and 150 parts 50% $H_2O_2$ are introduced for three hours into the reactor with vigorous agitation. The temperature is then adjusted to 97° C. and allowed to postreact for five hours further. After cooling, a 50.2% polymer solution with a viscosity of 1800 mPa.s is obtained. The polymer has an average molecular weight of 25,000 g/mole. The structure —$CH_2$—CH—(COO—$CH_2$—$CH_2$—)$_r$COOR'—can be demonstrated to be approximately 10% by weight by 1H-NMR.

EXAMPLE 3

600 parts acrylic acid and 150 parts acrolein are used as monomers with a method similar to the one in Example 2. The raw materials are introduced over 2 hours. The resulting 50.5% polymer solution has a viscosity of 2200 mPa.s. The polymer has an average molecular weight of 20,000 g/mole. The structure —$CH_2$—CH—(COO—$CH_2$—$CH_2$—)$_r$COOR'—can be demonstrated to approximately 4% by weight by 1H-NMR.

EXAMPLE 4

675 parts acrylic acid and 75 parts acrolein are used as monomers according to the method of Example 2. The 52.5% solution obtained had a viscosity of 6700 mPa.s and contains a polymer with an average molecular weight of 21,000 g/mole and approximately 1% by weight of the structure —$CH_2$—CH—(COO—$CH_2$—$CH_2$—)$_r$COOR'—.

EXAMPLE 5

200 parts by weight deionized water are placed in a reactor in accordance with Example 1 and heated to 95° C. Within two hours, a solution of 53 parts sodium peroxodisulfate in 320 parts deionized water, 510 parts β-carboxyethylacrylate, 90 parts acrylic acid and 320 parts deionized water are simultaneously introduced with vigorous agitation. A postreaction at 98°–100° C. subsequently takes place for 1.5 hours.

The water-thin 42.1% solution obtained is cloudy and tends toward phase separation; after neutral adjustment by 1M NaOH, complete solubility is achieved. The polymer has an average molecular weight of 5200 g/mole and contains, according to NMR evaluation, approximately 85% by weight of the structure —$CH_2$—CH—(COO—$CH_2$—$CH_2$—)$_r$COOR'—.

DESCRIPTION OF DETERGENT FORMULATIONS

The use of the copolymers on an acrylic acid/acrolein basis in detergent formulations is of particular practical significance, since they reduce the disadvantages of known detergents to a considerable extent. In addition to the novel copolymers, these detergents in accordance with the invention also contain conventional substances which are to be described, in the following, in detail:

A) Surface Active Agents

The amount of the surfactant component in the total detergent recipe is between 5–40% by weight, preferably between 7–30% by weight, and especially between 10–20% by weight. Both anionic and non-ionic surfactants may be used. The amount of the anionic surfactants should be at least 5% by weight and is preferably in a range between 5–10% by weight. In particular, sulfates and sulfonates have a practical significance as anionic wash-active substances. The sulfonates include e.g. alkylbenzene sulfonates, preferably with straight-chain alkyl groups, olefin-, alkane- or also fatty acid ester sulfonates.

Surfactants of the sulfate type are fatty alcohol sulfates, e.g. from coconut oil or tallow fatty alcohols.

The non-ionic surfactants include e.g. polyethylene oxide condensates of primary and secondary aliphatic alcohols, alkyl phenols or also alkylpolyglycosides in a range between 0–20% by weight, preferably between 0–10% by weight.

B) Builder components

The detergent should contain one or several detergent builders. Preferably synthetic sodium aluminum silicates of the zeolite A type are to be cited here from the area of ion exchangers. Furthermore, zeolite NaX or zeolite P as well as a mixture of the cited compounds are suitable. This detergent component is present in the formulation in an amount of 5–50% by weight, preferably with 10–30% by weight. The polycarboxylates of the invention are used in a range of 0.1–20% by weight, advantageously at least 0.5% by weight, preferably at least 1% by weight and especially, however, in a range of 2–10% by weight.

Further inorganic builders such as Na- or K carbonate or silicates (in crystalline and amorphous form) can supplement or complete the builder system. Each of both substance types can be used in a range between 0–30% by weight but preferably between 3–15% by weight.

Complexing agents such as nitrilo triacetic acid, whose proportion is 0–10% by weight, preferably 0.5 to 5% by weight, as well as di- or polyphosphonic acids in a range between 0–5% by weight, preferably 0.1–1% by weight, or derivatives of hydroxy carboxylic acids such as citrate or tartrate in a range between 0–20% by weight, preferably between 2–10% by weight can be used as builder components. Phosphates can be used in a range of 0–30% by weight.

C) Bleaching agent/bleaching-agent activators

In particular, sodium perborate tetrahydrate and monohydrate or coated percarbonates have a practical significance in the case of the bleaching agents yielding $H_2O_2$ in water. They are used in a range between 0–30% by weight, preferably between 10–25% by weight.

Organic N-acyl and O-acyl compounds such as e.g. TAED are of practical significance as bleaching-agent activators for per compounds. They are used in a range between 0–10% by weight, preferably of 2–8% by weight.

D) Enzymes

Enzymes can be worked into the detergent recipe which are specific for certain types of dirt, e.g. proteases, amylases or lipases. Combinations of enzymes with differing action are preferably used. Their application range is between 0–3% by weight, preferably in a range between 0.3–1% by weight.

E) Optical brighteners

Detergents can contain especially derivatives of the following compounds as optical brighteners: Stilbenes, biphenylstilbenes, diphenylpyrazolines, cumarin or combinations of benzoxazole or benzamidozole. They are used in a range of 0–5% by weight, preferably in a range of 0.1–0.3% by weight.

F) Additional greying inhibitors

The detergents can also contain greying inhibitors which suspend the dirt loosened from the fibers in the washing liquor. Methyl- or carboxymethylcelluloses can be cited here as examples. Their proportion in the detergent can be 0–5% by weight, especially 0.5–1.5% by weight.

G) Defoamers

Foam inhibitors are generally used in amounts of 0– 8% by weight. Soaps, silicon oils or even hydrophobic silicas are useful here. In the case of non-surfactant-like defoamers, generally amounts of 0–3.5% by weight are sufficient because their action is stronger in comparison to soaps.

CARRYING OUT WASH TESTS

It was possible to establish the improved effectiveness of the novel copolymers described above in wash tests which compared their performance with commercial detergent polymers. The market products (MP) used for purposes of comparison are a homopolymer (MP1) based on polyacrylate having an average molecular weight of 120,000 g/mole and a copolymer (MP2) based on acrylic/maleic acid (approximately 30/70) with an average molecular weight of 70,000 g/mole. The structure —$CH_2$—CH—(COO—$CH_2$—$CH_2$—)$_r$COOH— could not be found in these products.

These products were tested in comparative wash tests according to DIN 44983 with the copolymers of Examples 1 to 5 (referred to in the following tables and in the drawings as B1, B2, B3, B4, B5, respectively).

A) Composition of the detergents (% by weight)

The polymers used in the detergents were neutralized with NaOH and resulted in an active-substance content of 40–54%.

| | Active content |
|---|---|
| B1 | 50.0% |
| B2 | 50.8 |
| B3 | 54.0 |
| B4 | 50.4 |
| B5 | 40.7 |
| MP1 | 40.0 |
| MP2 | 40.0 |

Only the polymers were varied in the detergent formulations and the other detergent components were kept the same for each formulation. The active content of the polymers used was calculated at 4%. The balancing-out in the formulation, to compensate for the differing solid contents of the polymers, was achieved with sulfate. The basic composition of the detergent formulation was:

| | |
|---|---|
| Marlon ARL | 9.38 |
| Dehydol TA5 | 0.80 |
| Dehydol LT7 | 3.20 |
| Edenor HT35 | 2.80 |
| Blankophor | 0.15 |
| Tinopal CBS-X | 0.02 |
| Relatin HC-Comp | 1.10 |
| Trilon B | 0.23 |
| Soda | 10.00 |
| Perborate $4H_2O$ | 20.00 |
| Portil N | 3.00 |
| Wessalith CS | 32.90 |
| TAED | 3.18 |
| Alcalase 2.5T | 0.50 |

The amounts of added polymer and sulfate were:

| | Polymer | Sodium sulfate |
|---|---|---|
| B1 | 8.00 | 4.74 |
| B2 | 7.89 | 4.85 |
| B3 | 8.49 | 4.25 |
| B4 | 7.94 | 4.80 |
| B5 | 9.83 | 2.91 |
| MP1 | 10.0 | 2.74 |
| MP2 | 10.0 | 2.74 |

B) Wash conditions

The wash conditions are described in the following table:

Washing machine type: Miele W 763

Program of the washing machine: boiling/colored laundry without prewash

| | |
|---|---|
| Temperature/hardness: | 60° C./20 dH |
| Amount of detergent: | 130 g (10.0 g/l) |

-continued

| | |
|---|---|
| Ballast material: | 20 pieces of cotton, white<br>3 pieces of terry cloth<br>2 pieces hand towels<br>weight - 3.3 kg |
| White fabrics: | Terry cloth, hand towel, cotton and coton-green strips (WFK) 0.8 kg |
| Hardening: | At each second wash<br>Blood (EMPA 111)<br>Standard (EMPA 101)<br>Sebaceous matter (WFK 10 D)<br>Tea, (WFK 10) |
| Secondary washing power: | 1 cycle, 25 washes |

Incrustation and greying were determined after the 10th and the 25th wash

The Wäschereiforschung Krefeld (WFK) [Krefeld Laundry Research] and the Eidgenössische Material Prüfanstalt (EMPA) [Swiss Material-Testing Institute] Switzerland sell test soilings which were used for wash tests. These test soilings are referred to as, e.g., EMPA 111 for blood soilings, etc.

3.) Determination of the measured values for determining the secondary wash power The greying or depositing of dirt is determined via the R 457 nm reflection by means of a spectral photometer (DC 3890) of the firm Datacolor. The degree of whiteness is determined for the new fabrics as the zero value before the wash cycle. The results of greying are indicated as reflectance reduction (delta R=R zero value–R measured). Five measuring points are determined for each white fabric and the mean value and scattering calculated therefrom. The LSD value (least significant difference) is calculated according to DIN 44983, part 50. The sequence results from assigning notes to the individual measured valued determined for the various fabrics.

The determination of the incrustation takes place via the ash content (double determination). Each 2 g fabric are calcined in a pre-incinerator at 500° C. (for 1 hour) and subsequently washed 1 hour in a muffle furnace at 800° C. The crucibles are re-weighed.

Results

Figure 3:
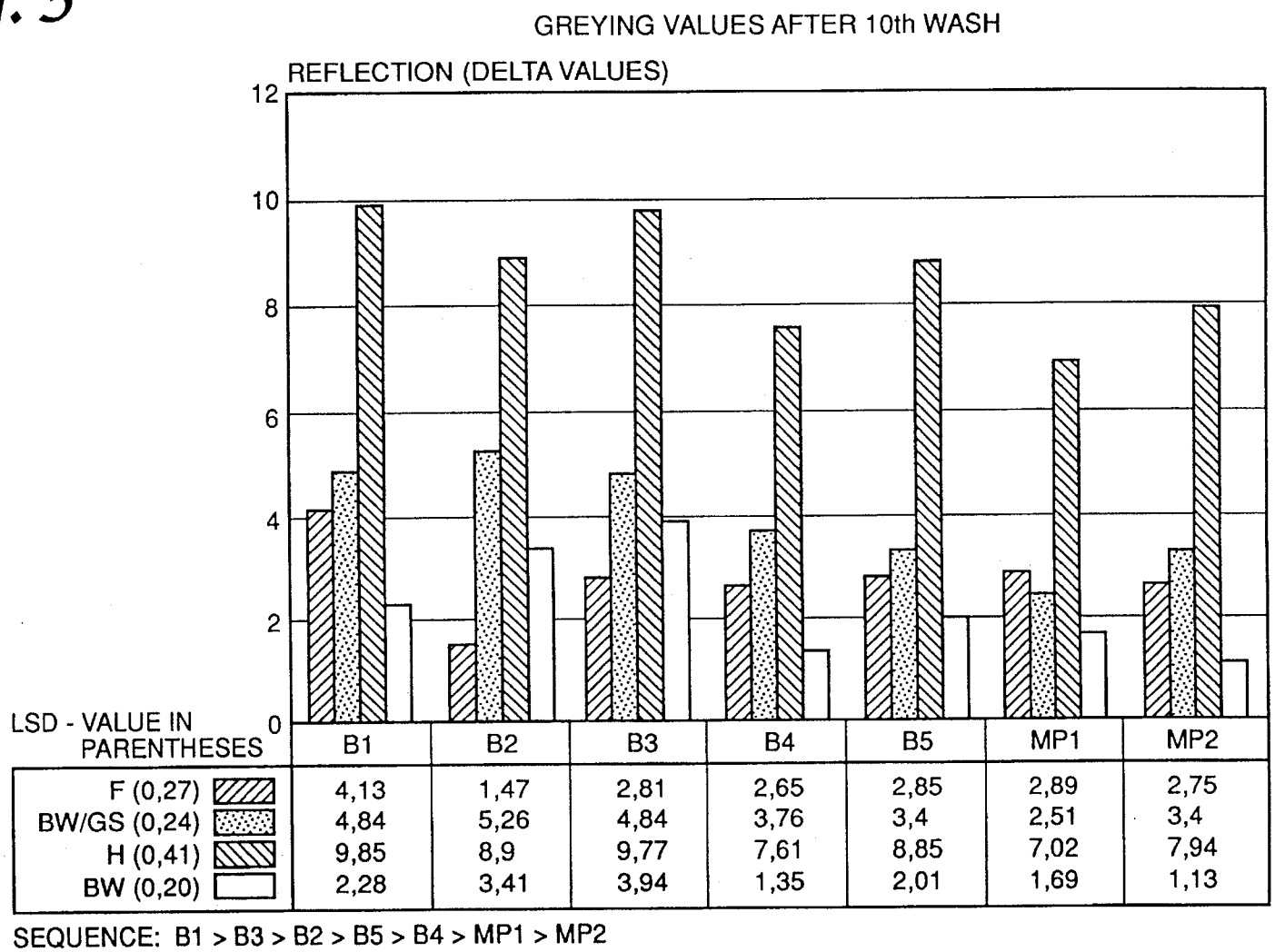
FIG. 3 shows greying values after the 10th wash.

Greying after the 10th wash (FIG. 3): Good wash results with terry cloth (F) can be determined especially in the case of the product of Example 1, with an R of 4.13. Examples 3 (R=2.81) and 5 (R=2.85) show results significantly comparable to the market products MP1 (R=2.89) and MP2 (R=2.75), since the LSD value is 0.27. Examples 2 (R=1.47) and 4 (R=2.65) exhibit inferior performance with terry cloth in comparison to the two market products.

Example 2 (R=5.26) shows the best results on the test fabric cotton with green stripes (BW/GS), followed by examples 1 and 3 (both at the same level: R=4.84) and by example 4 (R=3.76). The market products exhibit a poorer greying inhibition with these fabrics. The R value for MP1=2.51 and for MP2=3.4. The LSD value determined was approximately 0.24.

Even in the inhibiting of greying on the huckaback towel (H) the market products (R of MP1=7.02, MP2=7.94) exhibit a declining performance in comparison to the examples in accordance with the invention. Only Example 4 (R=7.61) is significantly comparable to the performance of MP2. Examples 1, 2, 3 and 5 exhibit R values >8.85. Example 1 (R=9.85) and example 3 (R=9.77) exhibit the best results. The LSD value was determined at 0.41.

Example 3 shows the best washing results with cotton test fabrics (BW), followed by Example 2 (R=3.41), Example 1 (R=2.23) and Example 5 (R=2.01). Poorer results were displayed by market product 1 (R=1.69), Example 4 (R=1.35) and market, product 2 (R=1.13). The LSD value in this measuring series was 0.20.

Figure 4:
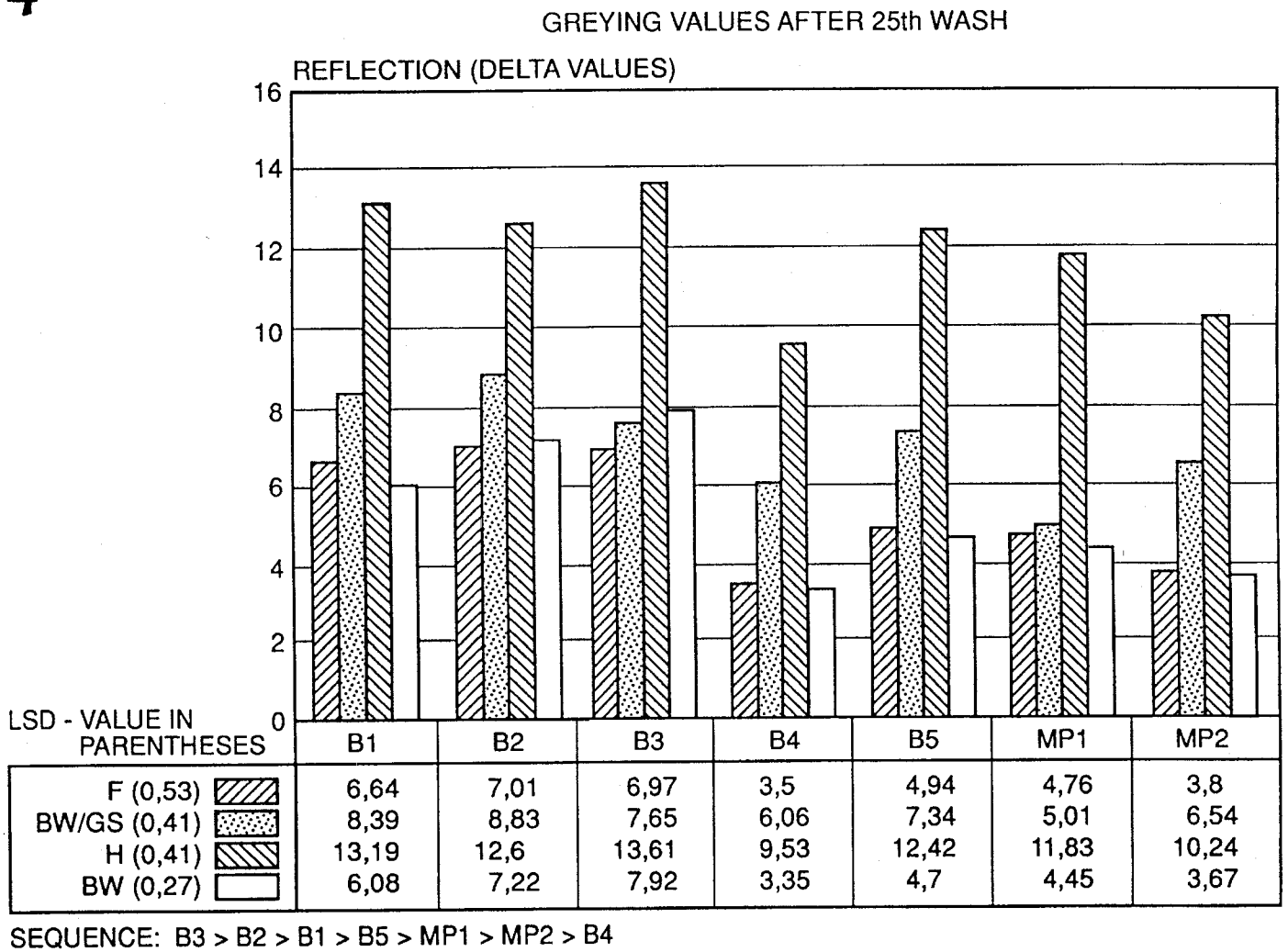
FIG. 4 shows greying values after the 25th wash.

Greying after the 25th wash (FIG. 4)

The polymers of Example 1 (R=6.94), Example 2 (R=7.01) and Example 3 (R=6.97) exhibit the best inhibition of greying on terry cloth, followed by Example 5 (R=4.94) and market product 1 (R=4.76). The poorest results of this series are exhibited by market product 2 (R=3.8) and example 4 (R=3.50). The LSD value is 0.53.

The good performances of Example 2 (R=8.83) and of Example 1 (R=8.39) on BW/GS are to be particularly emphasized. Example 3 (R=7.65) and Example 5 (R=7.34), which are to be classified as of equal standing on account of the LSD value of 0.41, exhibit somewhat poorer washing performances. A further drop in the inhibiting of greying is displayed by market product 2 (R=6.54), Example 4 (R=6.06) and market product 1 (5.01).

The best result on the huckaback towel is shown by Example 3 (R=13.61), followed by Example 1 (R=13.19), which are to be considered as being of equal standing with an LSD value of 0.41. Example 2 (R=12.6) and Example 5 (R =12.42) display slightly falling reflections and are likewise to be considered as being of equal standing. Further diminished results are displayed again by market product 1 (R=11.83), market product 2 (R=10.24) and Example 4 (R =9.53).

Once again, Example 3 (R=7.92) exhibits advantages on the cotton test fabric in comparison to the other polymers, followed by Example 2 (R=7.22), Example 1 (R=6.08), Example 5 (R=4.7), MP1 (R=4.45) and MP2 (R=3.67). The values of Example 5 and market product 1 are to be considered as equivalent at an LSD value of 0.27.

In the total evaluation of the inhibition of greying of all fabrics investigated after the 25th wash, the newly developed polymers, except for Example 4, again display advantages in comparison to the market products. The sequence in the total evaluation looks like this:

Inhibition of greying: B3>B2>B1>B5>MP1 >MP2>B4.

Incrustation after the 10th wash

Figure 5:
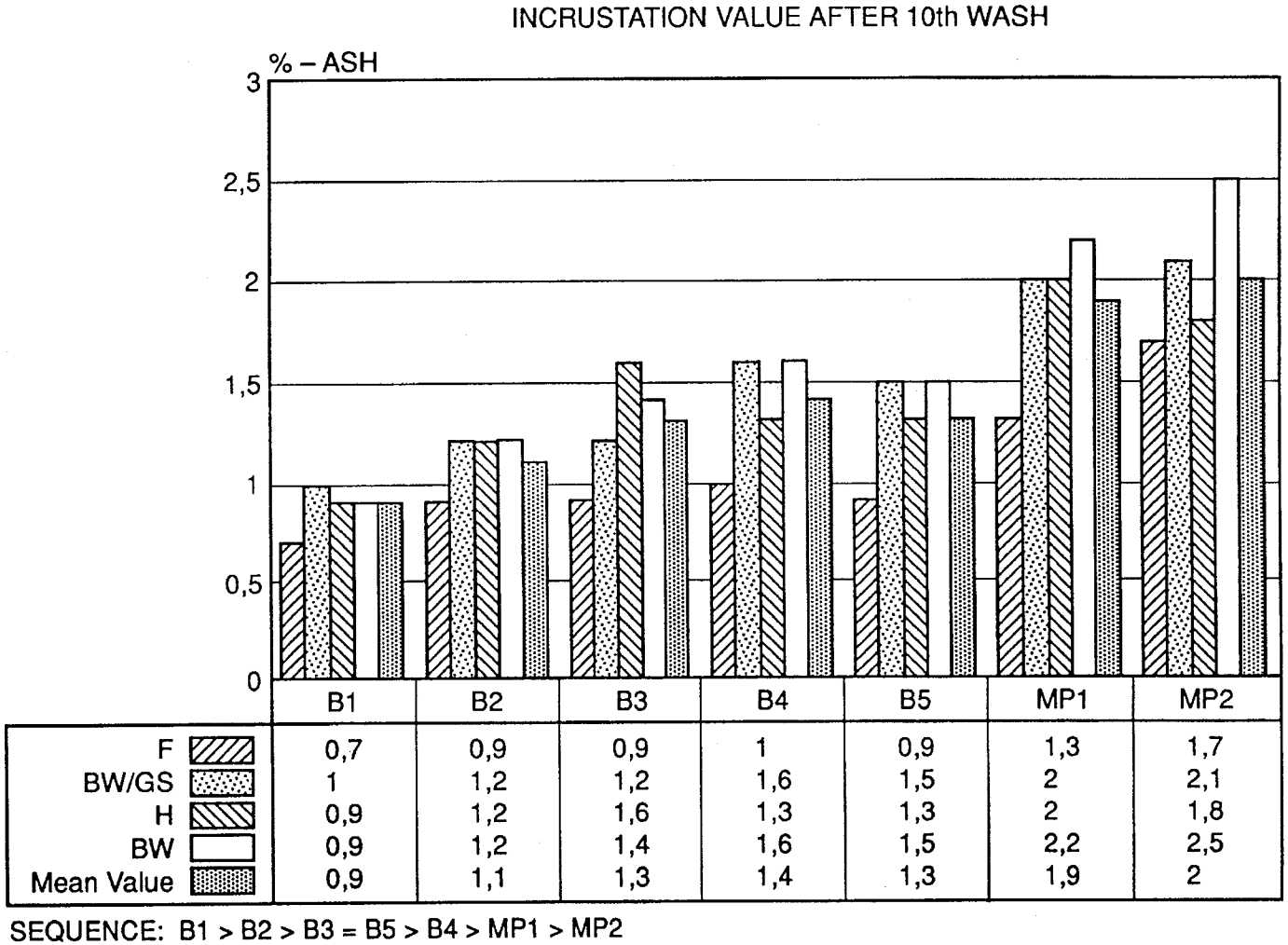
FIG. 5 shows incrustation values after the 10th wash.

In the evaluation of the wash incrustation after the 10th wash (FIG. 5), significant advantages can be clearly determined for all 5 examples over the market products due to the low ash values and this is true for all fabric types investigated. The mean value of the ash contents determined from the four fabrics, terry cloth, cotton/green stripes, huckaback towel and cotton/white rises with the content of acrylic acid in the individual polymers from 0.9% ash (B1), 1.1% (B2), 1.3% (B3) to 1.4% (B4). Example 5 exhibits results comparable to B3. On the other hand, the two market products exhibit inferior performances: Their ash content is approximately 1.9% (MP1) and 2.0% (MP2).

The sequence in the reduction of incrustation results as: B1>B2>B3=B5>B4>MP1>MP2.

Figure 6:
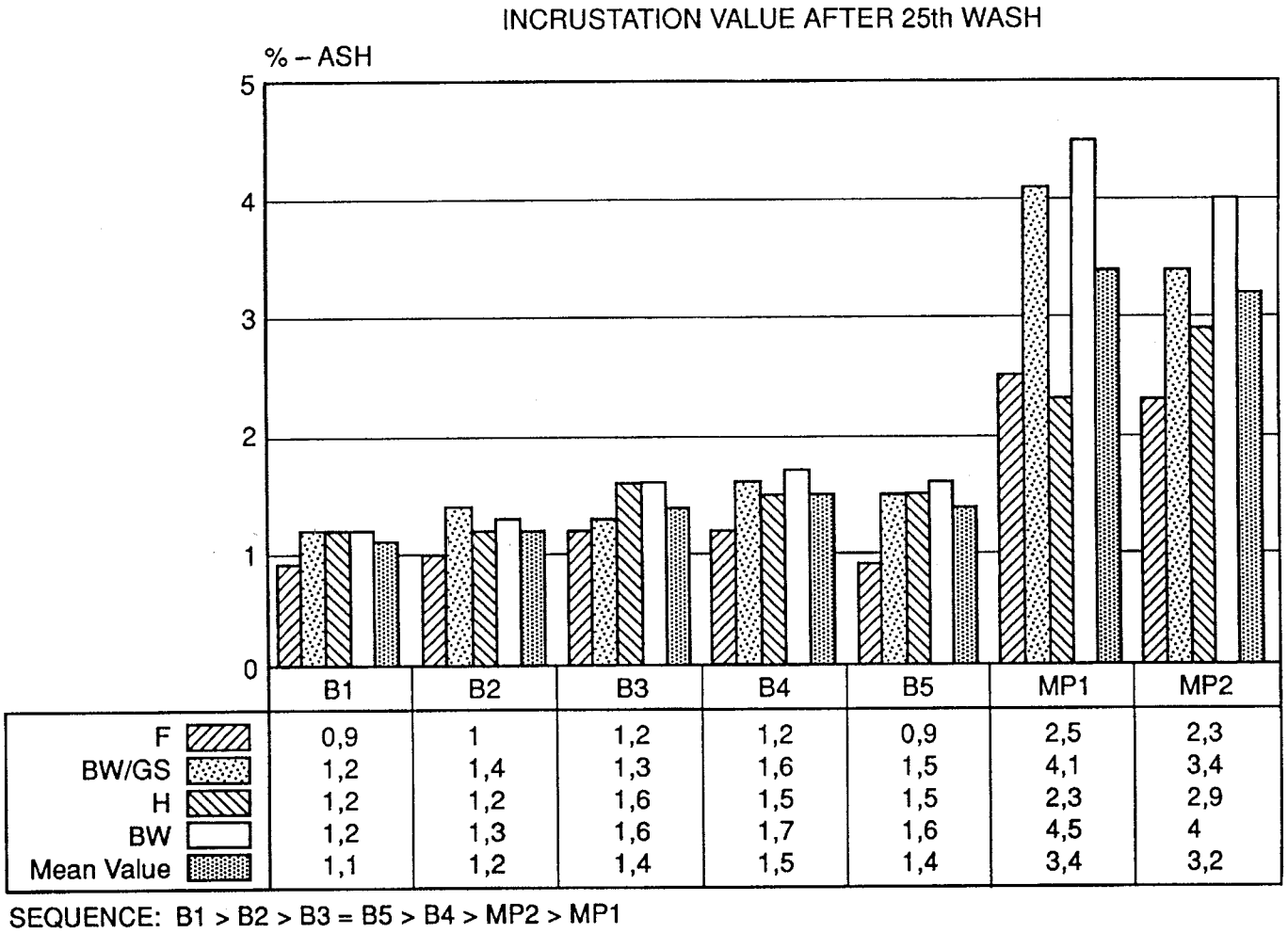
FIG. 6 shows incrustation values after the 25th wash.

This advantage also remains preserved for the polymer types of the invention after the 25th wash (FIG. 6). Whereas for the novel polymers the ash contents vis-à-vis the 10th wash vary only slightly between 0.1 and 0.2% (B1=1.1%, B2=1.2%, B3=1.4%, B4=1.5%, B5=1.4%), the market products exhibit incrustation values of 3.4% (MP1) and 3.2% (MP2).

The sequence of the newly developed polymers remains as after the 10th wash; only the sequence of the market products is reversed: B1>B2>B3=B5>B4>MP2>MP1.

WASH TESTS WITHOUT ZEOLITE A

These wash tests show that the polymers to be used in accordance with the invention achieve their superior action especially together with zeolites. The above-described detergent formulation was again selected as the base for the following test. Only, zeolite A was replaced by the wash alkalis sodium carbonate and sodium disilicate. Example B1 and market product MP1 were selected as reference polymers. Since Wessalith CS is a granulated zeolite A which also contains, in addition to zeolite A, 2% CMC, 1.7% NaSO4 and 2.6% nonionic surfactant, these substances were calculated separately for to the respective product groups, so that the formulations differ from the active substances only in the builder content.

Figure 7:
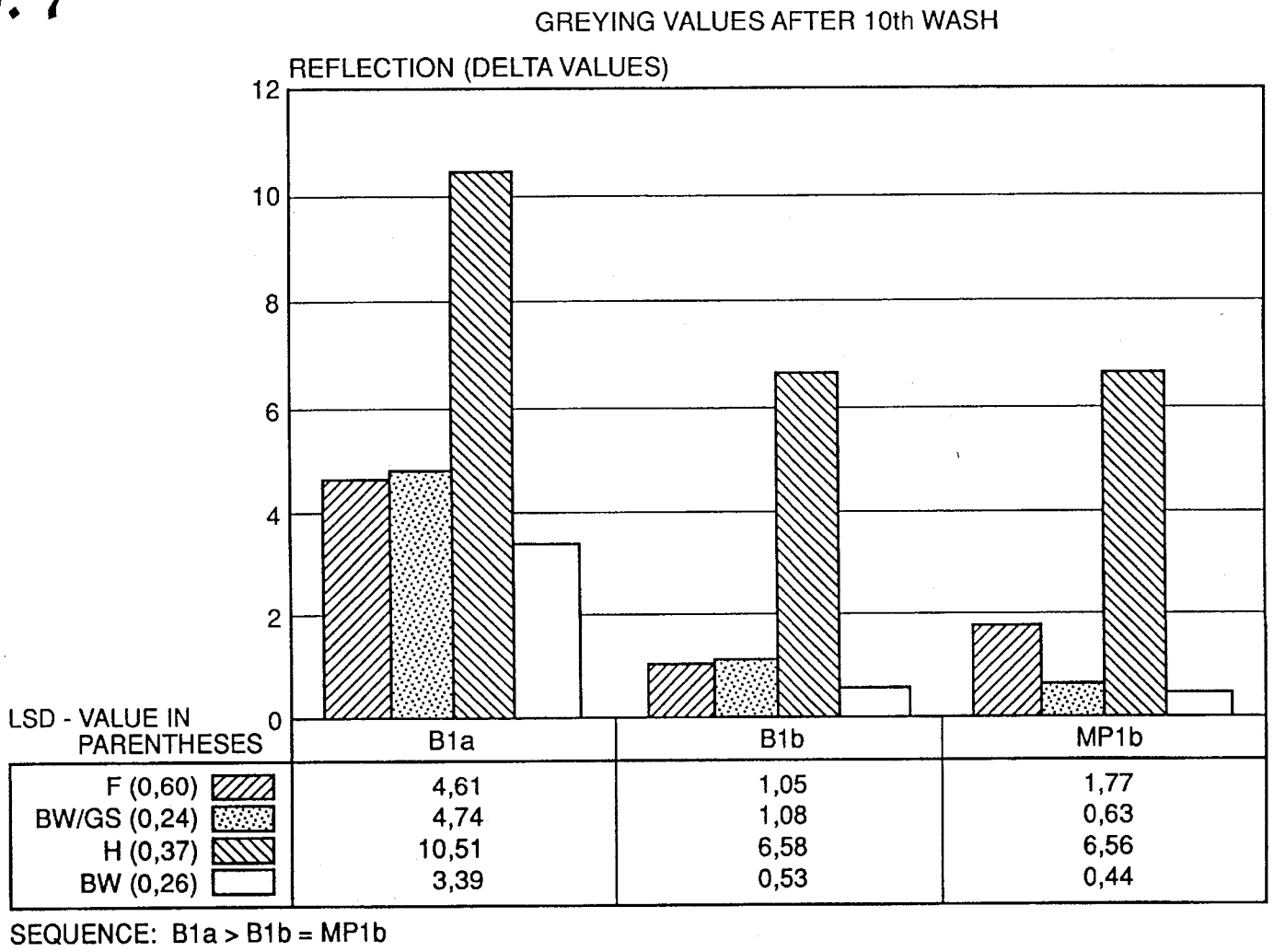
FIG. 7 shows comparative wash tests without zeolite, greying values after the 10th wash.

| | B1a | B1b | MP1b |
|---|---|---|---|
| Marlon ARL | 9.38 | 9.38 | 9.38 |
| Dehydol TA5 | 0.8 | 1.66 | 1.66 |
| Dehydol LT7 | 3.2 | 3.2 | 3.2 |
| Edenor HT35 | 2.8 | 2.8 | 2.8 |
| Blankophor | 0.15 | 0.15 | 0.15 |
| Tinopal CBS-X | 0.20 | 0.02 | 0.02 |
| Relatin HC-Comp | 1.1 | 1.8 | 1.8 |
| Trilon B | 0.23 | 0.23 | 0.23 |
| Perborate $4H_2O$ | 20 | 20 | 20 |
| TAED | 3.18 | 3.18 | 3.18 |
| Alcalase 2, 5T | 0.5 | 0.5 | 0.5 |
| Na-sulfate | 4.74 | 5.31 | 3.3 |
| Wessalith CS | 32.9 | — | — |
| Polymer | 8.0 | 8.0 | 10.0 |
| Soda | 10 | 30 | 30 |
| Portil N | 3 | 13.78 | 13.78 |
| Results: | | | |
| Greying after the 10th wash (FIG. 7) | | | |

It was possible to achieve good wash results with terry cloth (F) with formulation B1a with a R value of 4.61. Worse performances were exhibited by MP1b (R=1.77), followed by B1b (R=1.05). The LSD value was approximately 0.6.

B1a (R=4.74) was also the best with the test fabric of cotton with green stripes, followed by formulation B1b (R =1.08) and MP1b (R=0.63).

The good performance of formulation B1a (R=10.51) is also confirmed with the huckaback towel (H). The greying values of B1b and MP1b are to be considered as being of equal standing with R=6.58 and 6.56 at an LSD value of 0.37.

Figure 8:
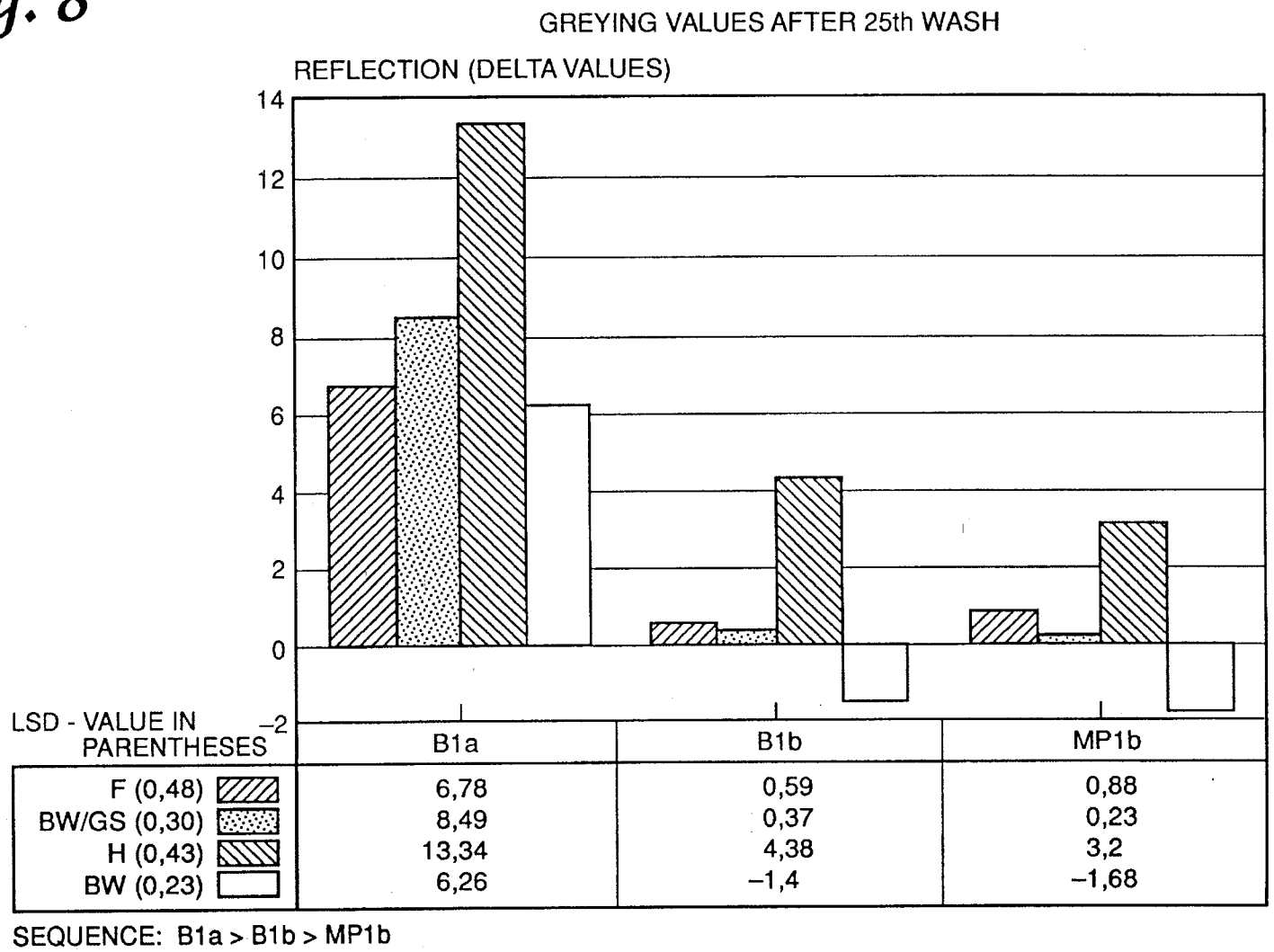
FIG. 8 shows greying values after the 25th wash.

The same trend is displayed with the cotton test fabric (BW). B1a exhibits the best value with R=3.39, followed by B1b and MP1b, which are to be considered as of equal standing at an LSD value of 0.26 with R=0.53 and 0.44. Sequence: B1a>B1b=MP1b Greying after 25 washes (FIG. 8)

After 25 washes, formulation B1a with R=6.78 on terry cloth still exhibits the best results, followed by formulation MP1b and B1b, which are of equal standing with R=0.88 and 0.59 at an LSD value of 0.48.

The same trend is exhibited with the cotton/green-striped fabric. The LSD value is 0.3, the R values of B1a are 8.49, of B1b, 0.37 and of MP1b, 0.23.

In the case of the huckaback towel, formulation B1a shows the best results with R=13.34, followed by formulation B1b (R=4.38) and MP1b with R=3.2. The LSD value is 0.43.

Figure 9:
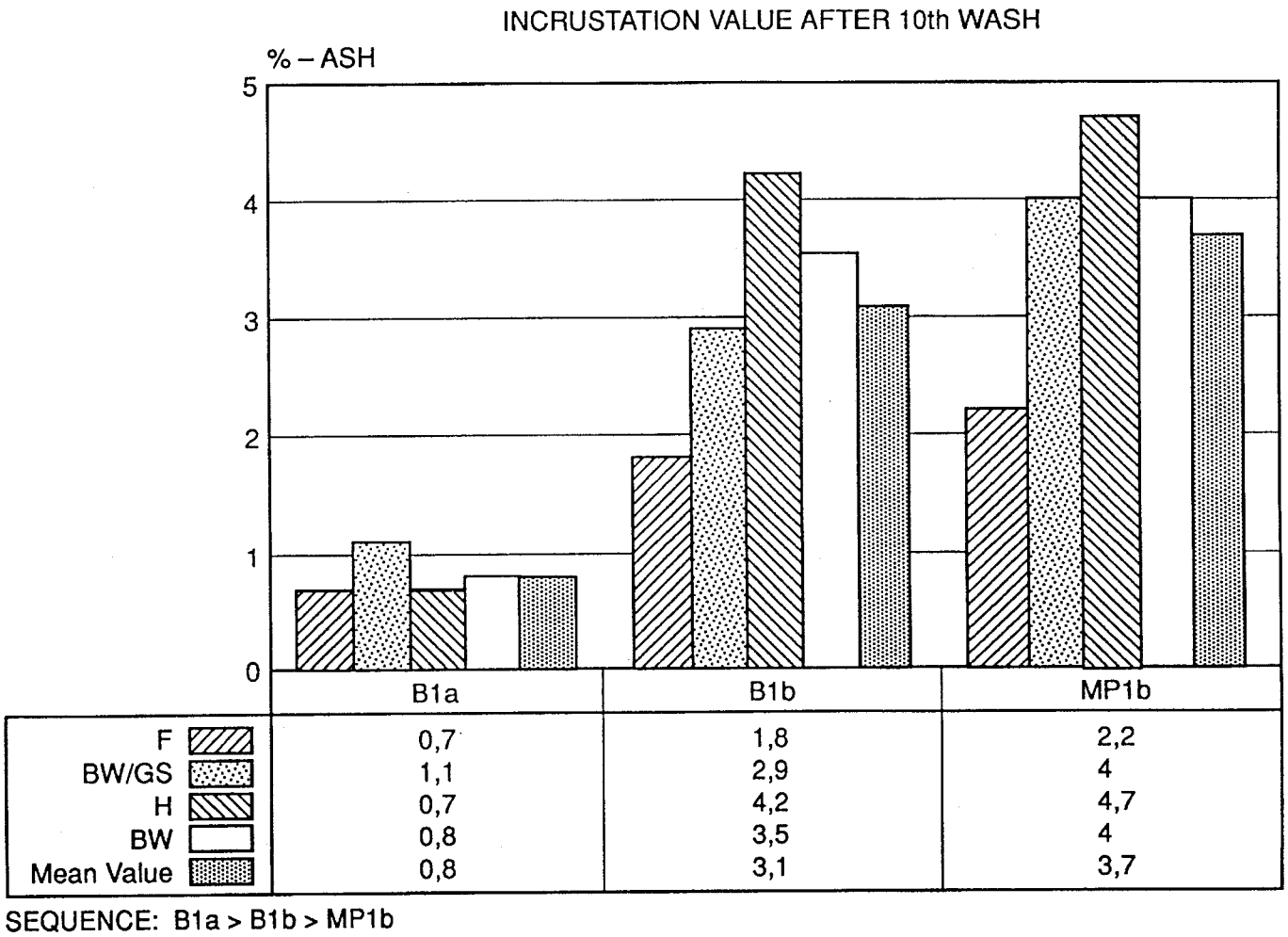
FIG. 9 shows incrustation values after the 10th wash.

With the cotton fabric, MP1b again exhibits the poorest wash performance (R=−1.68). Better results are shown by formulation B1b (R=−1.4) and B1b (R=6.26). The LSD value is 0.23. Sequence: B1a>B1b>MP1b Incrustations 10th wash (FIG. 9)

Figure 10:
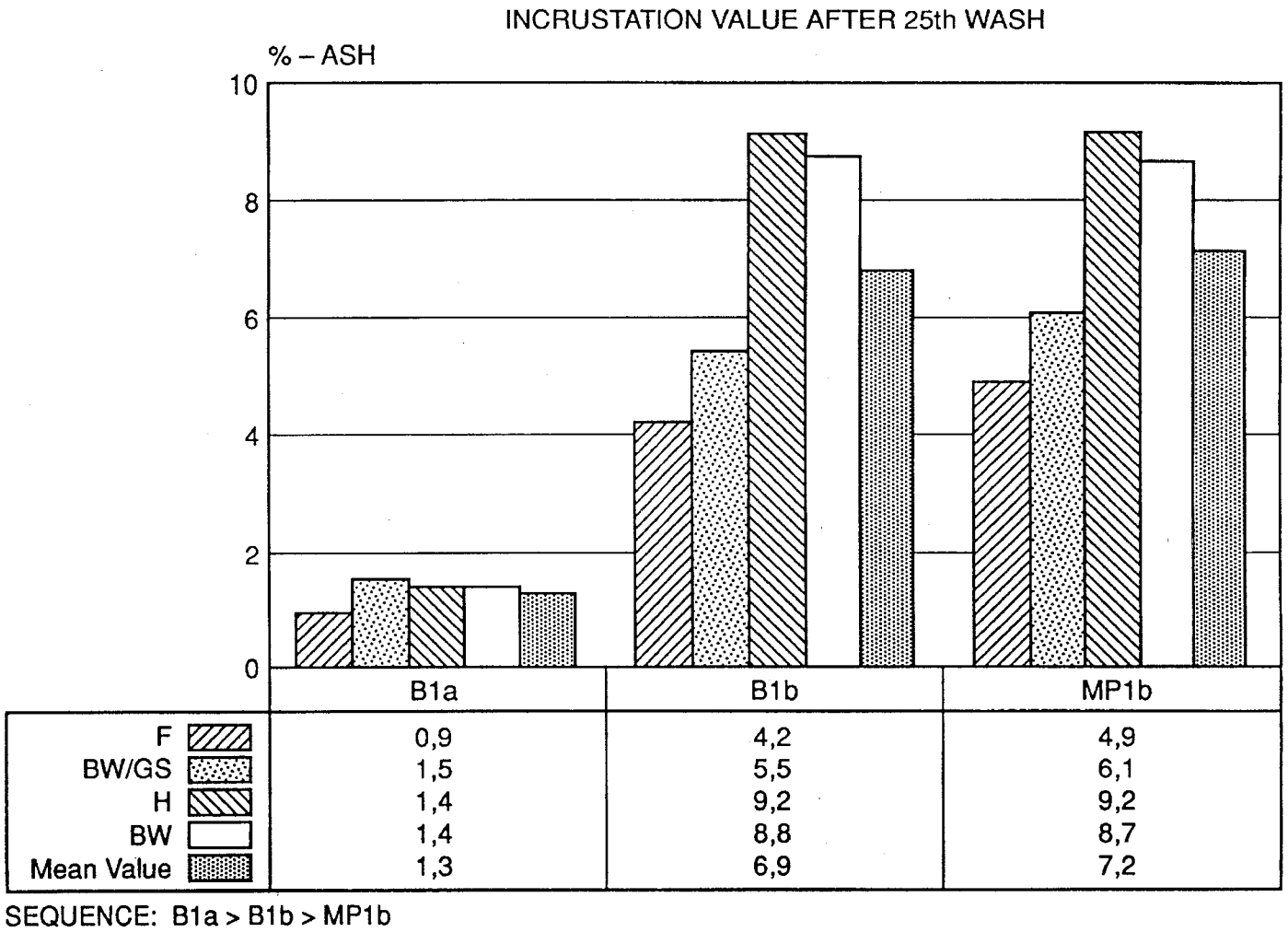
FIG. 10 shows incrustation values after the 25th wash.

The least ash contents on the fabrics terry cloth, cotton/green stripes, huckaback towel and cotton are displayed with values of 0.7%, 1.1%, 0.7% and 0.8% by Example B1a with a mean value from all test fabrics of 0.8%. Poorer performances are shown by formulation B1b with ash contents of 1.8% (terry cloth), 2.9% (cotton/green stripes), 4.2% (huckaback towel) and 3.5% (cotton). The mean value is 3.1%. The ash contents of example MP1b displayed the following values at the same soilings: 2.2% (terry cloth), 4.0% (cotton/green stripes), 4.7 (huckaback towel) and 4.0% (cotton). The mean value is approximately 3.7%. Sequence: B1a>B1b>MP1b Incrustation 25th wash (FIG. 10)

The same sequence as after 10 washes was displayed. In Example B1a the incrustations on the various fabrics rose after 25 washes to 0.9% (terry cloth), 1.5% (cotton/green stripes), 1.4% for the huckaback towel and the cotton fabric. The mean value is approximately 1.3%. Considerably higher incrustations occur with formulations B1b and MP1b. Formulation B1b exhibited the following results: 4.2% residue with the terry cloth, 5.5% with the cotton/green stripes, 9.2% with the huckaback towel and 8.8% with the cotton fabric. The mean value of all ash residues was 6.9 %. The following values were obtained for formulation MP1b: 4.9% for terry cloth, 6.1% for cotton/green stripes, 9.2% for huckaback towel and 8.7% for cotton. The mean value is approximately 7.2%. Sequence: Ba1>B1b>MP1b Result B1a is clearly superior to B1b and MP1b, and B1b hardly displays advantages over MP1b.

What is claimed is:

1. A detergent composition containing:

| | |
|---|---|
| Surfactant | 5–40% by weight |
| Calcium-binding silicate | 5–50% by weight |
| Polycarboxylate | 1–20% by weight |
| Other silicate | 0–30% by weight |
| Carbonate | 0–30% by weight |
| Organic complexing agent | 0–10% by weight |
| Phosphate | 0–30% by weight |
| Hydroxycarboxylic acid | 0–20% by weight |
| Bleaching agent | 0–30% by weight |
| Bleaching-agent activator | 0–10% by weight |
| Optical brightener | 0–5% by weight |
| Enzyme | 0–30% by weight |
| Greying inhibiter | 0–5% by weight |
| Defoamer | 0–8% by weight |
| Fillers | 0–40% by weight |

with at least 1% by weight of the composition being a polycarboxylate having an average molecular weight of between 500 and 500,000 with the structure (X, Y, Z) in which X stands for

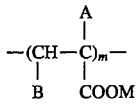

Y stands for

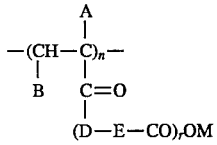

and Z for $$-(F)_q-,$$

in which

A=H, OH, $C_{1-6}$ alkyl, $CH_2CO(DECO)_{r-1}OM$;

B=H, OH, $C_{1-6}$ alkyl, COOM

D=O, NH

E=$C_{1-6}$ alkyl

F=a copolymerizable monomer;

M=H, alkali metal or alkaline-earth metal, ammonium, substituted ammonium or —$(CH_2—CH_2—O)_{2-4}M^1$ wherein $M^1$ is allowed to have the meaning of M except $(CH_2—CH_2—O)_{2-4}$ $M^1$;

r=1–5;

and m=0"99.5 molar % n=0.5–100 molar % q=0–99.5 molar % where m+n+q=100 molar % and said Y is at least about 1% by weight of said polycarboxylate.

2. The detergent composition according to claim 1, formulated as a compact detergent, and containing:

Polycarboxylate 2–8% by weight

Bleaching agent activator 2–8% by weight.

3. The detergent composition according to claim 1 formulated as a liquid detergent containing:

| | |
|---|---|
| Anionic surfactant | 5–15% by weight |
| Non-ionic surfactant | 10–20% by weight |
| Calcium-binding silicate | 10–25% by weight |
| Polycarboxylate | 1–5% by weight |
| Bleaching agent | 0% by weight |
| Bleaching-agent activator | 0% by weight |
| Co-builder | 0–8% by weight |
| Solubilizer | 0–30% by weight |
| Water | 0–50% by weight. |

4. The detergent composition according to claim 1 formulated as a fine-fabric detergent containing:

| | |
|---|---|
| Anionic surfactants | 5–15% by weight |
| Non-ionic surfactants | 1–10% by weight |

-continued

| | |
|---|---|
| Calcium-binding silicate | 10–50% by weight |
| Polycarboxylate | 1–5% by weight |
| Bleaching agent | 0% by weight |
| Bleaching-agent activator | 0% by weight |
| Carbonate | 0–20% by weight. |

5. A method of laundering textile materials which comprises washing the textile materials with a detergent composition as set forth in claim 1.

6. The detergent composition according to claim 1 in which the polycarboxylate is mixed with all of the components.

7. The detergent composition according to claim 1 in which the polycarboxylate is mixed with at least several of the components in the presence of water and the composition is dried.

8. The detergent composition according to claim 1 which contains at least one of the following components:

| | |
|---|---|
| Surfactant | 7–30% by weight |
| Polycarboxylate | 2–10% by weight |
| Further silicate | 3–15% by weight |
| Carbonate | 3–15% by weight |
| Organic complexing agent | 0.5–5% by weight |
| Phosphonate | 0.1–1% by weight |
| Phosphate | 0–5% by weight |
| Hydroxycarboxylic acid | 2–10% by weight |
| Bleaching agent | 10–25% by weight |
| Bleaching-agent activator | 2–8% by weight |
| Optical brightener | 0.1–0.3% by weight |
| Enzyme | 0.3–1% by weight |
| Greying inhibitor | 0.5–1.5% by weight |
| Defoamer | 0–3.5% by weight |
| Fillers | 0–20% by weight. |

9. The detergent composition of claim 8 in which the amount of surfactant is 10–20% by weight and the amount of phosphate is 0–1% by weight.

* * * * *